US007441518B2

(12) United States Patent
Naegele et al.

(10) Patent No.: US 7,441,518 B2
(45) Date of Patent: Oct. 28, 2008

(54) INTERNAL COMBUSTION ENGINE AND METHOD OF OPERATING SAME

(75) Inventors: Claus Naegele, Stuttgart (DE); Hans Nickel, Cottenweiler (DE)

(73) Assignee: Andreas Stihl AG & Co. KG (DE)

( * ) Notice: Subject to any disclaimer, the term of this patent is extended or adjusted under 35 U.S.C. 154(b) by 116 days.

(21) Appl. No.: 11/502,041

(22) Filed: Aug. 10, 2006

(65) Prior Publication Data

US 2007/0034180 A1 Feb. 15, 2007

(30) Foreign Application Priority Data

Aug. 11, 2005 (DE) ..... 10 2005 037 928
Jul. 8, 2006 (DE) ..... 10 2006 031 685

(51) Int. Cl.
*F02B 33/04* (2006.01)
*F02B 25/00* (2006.01)

(52) U.S. Cl. ..... 123/73 A; 123/73 B; 123/73 PP

(58) Field of Classification Search ..... 123/73 A, 123/73 B, 73 BA, 73 AD, 73 PP
See application file for complete search history.

(56) References Cited

U.S. PATENT DOCUMENTS 5,503,119 A * 4/1996 Glover ..... 123/73 B
5,740,767 A * 4/1998 Kaku et al. ..... 123/65 W
5,992,358 A * 11/1999 Otome ..... 123/65 P
6,216,650 B1 * 4/2001 Noguchi ..... 123/73 A
6,557,504 B2 * 5/2003 Strom et al. ..... 123/73 A
6,591,794 B2 * 7/2003 Toda ..... 123/73 A
6,827,338 B2 * 12/2004 Nonaka ..... 261/44.3
6,843,469 B1 * 1/2005 Nonaka ..... 261/44.3
6,932,032 B2 * 8/2005 Lingen et al. ..... 123/73 A
7,168,401 B2 * 1/2007 Johnson ..... 123/73 A
7,257,993 B2 * 8/2007 Geyer ..... 73/114.24
7,258,107 B2 * 8/2007 Johnson et al. ..... 123/435
2005/0022790 A1 2/2005 Nickel et al.

* cited by examiner

*Primary Examiner*—Hai H Huynh
(74) *Attorney, Agent, or Firm*—Robert W. Becker; Robert W. Becker & Associates

(57) ABSTRACT

An internal combustion engine having an intake channel that opens into a crankcase. A first fuel channel opens into the intake channel to supply fuel thereto as a function of underpressure in the intake channel. An auxiliary channel opens into a transfer channel that fluidically connects a crankcase to the combustion chamber. A second fuel channel opens into the auxiliary channel and is connected to a storage reservoir for fuel. At least one valve controls the quantity of fuel to be supplied to the engine via the auxiliary channel. Largely fuel-free air is supplied to the engine via the intake channel during idling. During a first revolution of the crankshaft, fuel is supplied via the auxiliary channel, so that a combustible mixture can form in the combustion chamber. During a second revolution, largely fuel-free air is supplied via the auxiliary channel and the combustion chamber is scavenged with largely fuel-free air.

27 Claims, 8 Drawing Sheets

INTERNAL COMBUSTION ENGINE AND METHOD OF OPERATING SAME

The instant application should be granted the priority date of Jun. 9, 2005 the filing date of the corresponding German patent application 20 2005 009 049.2.

BACKGROUND OF THE INVENTION

The present invention relates to an internal combustion engine, and to a method of operating an internal combustion engine.

Applicants' pending published application US 2005/0022790 A1 discloses an internal combustion engine to which fuel/air mixture is supplied via an intake channel into the crankcase from a carburetor. Opening into the intake channel is a fuel opening that supplies fuel to the intake channel as a function of the underpressure in the intake channel. The fuel opening is supplied from a fuel channel in which is disposed a switching valve that is actuated as a function of the speed of the internal combustion engine.

During idling of such an internal combustion engine, a small quantity of mixture is supplied via the intake channel to the crankcase during each revolution, and from there is transferred via the transfer channels into the combustion chamber. Due to the small quantity of fuel, and the conditions in the combustion chamber, a combustion of the mixture in the combustion chamber cannot occur during each revolution. If combustion is not effected, a portion of the noncombusted fuel is scavenged out of the combustion chamber by the mixture that subsequently flows out of the crankcase. There thereby results an increased consumption of fuel during idling, and worsened emission values.

It is therefore an object of the present invention to provide an internal combustion engine of the aforementioned general type that has a low consumption of fuel and low exhaust gas values during idling. It is a further object of the invention to provide a method of operating an internal combustion engine by means of which low exhaust gas values can be achieved during idling operation.

BRIEF DESCRIPTION OF THE DRAWINGS

These and other objects and advantages of the present application will appear more clearly from the following specification in conjunction with the accompanying schematic drawings, in which.

SUMMARY OF THE INVENTION

Figure 1:
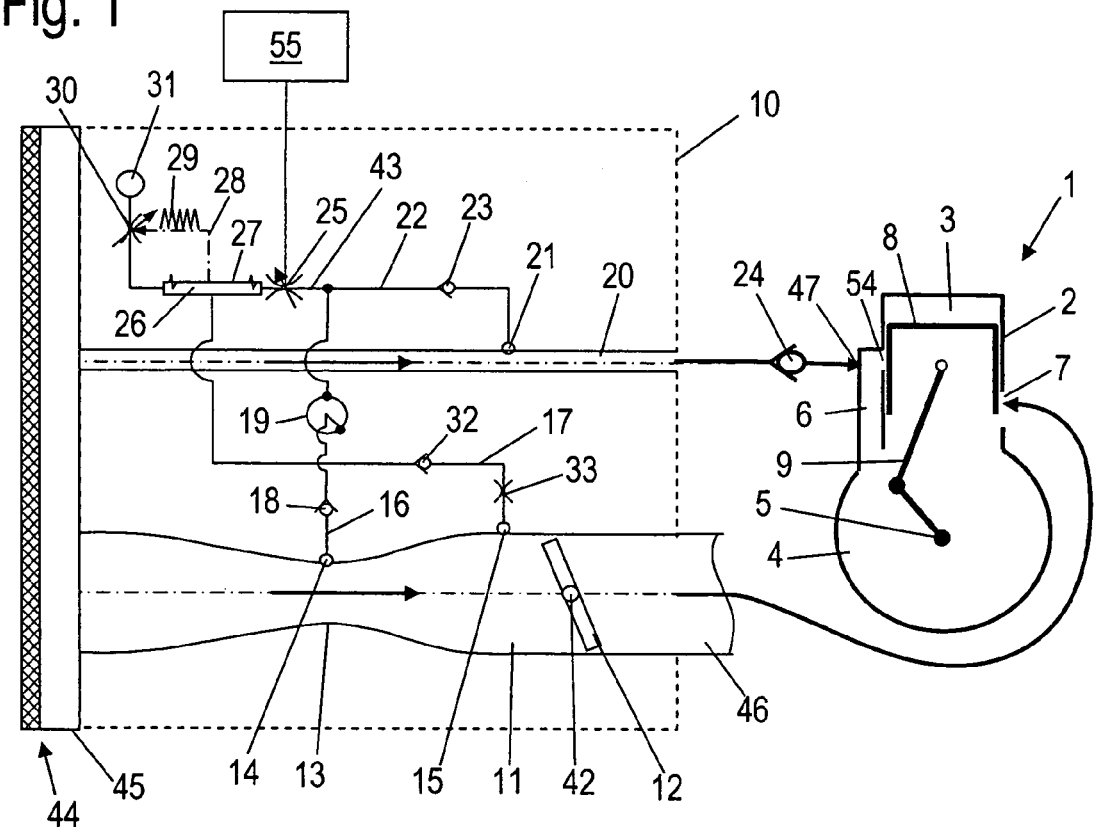
FIG. 1 illustrates an internal combustion engine having a carburetor.

The internal combustion engine of the present application comprises: a cylinder having a combustion chamber delimited by a piston reciprocally mounted in the cylinder, wherein the piston drives a crankshaft rotatably mounted in a crankcase, and at least one transfer channel fluidically connects the crankcase with the combustion chamber in prescribed positions of the piston; an intake channel that opens into the crankcase, wherein a first fuel channel opens into the intake channel and is adapted to supply fuel to the intake channel as a function of underpressure in the intake channel; an auxiliary channel that opens into the transfer channel, wherein a second fuel channel opens into the auxiliary channel and is connected to a storage reservoir for fuel; and at least one valve for controlling a quantity of fuel that is to be supplied to the internal combustion engine via the auxiliary channel.

The method of the present application for operating an internal combustion engine having a combustion chamber that is delimited by a piston reciprocally mounted in a cylinder, wherein the piston drives a crankshaft rotatably mounted in a crankcase, and wherein at least one transfer channel fluidically connects the crankcase with the combustion chamber in prescribed positions of the piston, and wherein an auxiliary channel opens into the transfer channel, includes the steps of supplying largely fuel-free air to the internal combustion engine via the intake channel during an idling operation, wherein during a first revolution of the crankshaft, fuel is supplied via the auxiliary channel, so that a combustible mixture can form in the combustion chamber, and wherein during a second revolution of the crankshaft largely fuel-free air is supplied via the auxiliary channel and the combustion chamber is scavenged with largely fuel-free air.

The auxiliary channel enables, with the valve, a rotationally-precise metering of the fuel. As a result, it is possible to supply fuel to the internal combustion engine during only those cycles during which a combustion is actually to take place. During idling, the crankcase can be rinsed with largely fuel-free air. During revolutions of the crankshaft of the internal combustion engine during which no combustion is to take place, the combustion chamber can thereby be scavenged with largely fuel-free air. This prevents uncombusted fuel from being scavenged out of the combustion chamber. This leads to a lower consumption of fuel during idling, and to a reduction of the emission values. Due to the fact that the auxiliary channel opens into the transfer channel, during idling at most insignificant quantities of fuel pass into the crankcase. The fuel supplied to the transfer channel is still rinsed into the combustion chamber in the same cycle. During the subsequent cycle, a largely fuel-free scavenging of the combustion chamber with air from the crankcase is thus possible. In these cycles, merely largely fuel-free air is supplied via the auxiliary channel, since the valve is kept closed in these cycles.

Since during idling the supply of fuel is essentially effected via the auxiliary channel, a pooling of fuel in the intake channel can be avoided; with known internal combustion engines, such pooling occurs in the intake channel during idling due to the low flow velocities. As a result, no surge-like transfer of fuel into the crankcase can occur any longer, so that the internal combustion engine runs quietly. Since during full throttle the fuel is supplied via the crankcase, an adequate lubrication of the moving parts in the crankcase occurs, so that no separate device is necessary for lubrication of the crankcase.

The internal combustion engine has a carburetor. In this connection, the first fuel channel opens into an intake channel section formed in the carburetor in the region of a venturi section. As a result, in the region of the opening-out an adequate underpressure is achieved for drawing fuel into the intake channel. The valve is preferably electrically actuatable. As a result, it is easy, for example as a function of the speed of the internal combustion engine, to control at which revolutions of the crankshaft a supply of fuel into the auxiliary channel is to take place. However, the valve can also be mechanically actuated. The mechanical actuation is in particular effected as a function of the operating state of the internal combustion engine, for example as a function of engine load. A mechanical actuation can easily be realized, thus resulting in a simple construction of the internal combustion engine.

To achieve a rotationally-precise metering, the volume of the auxiliary channel between the opening of the second fuel channel into the auxiliary channel, and the opening of the auxiliary channel into the transfer channel, corresponds at most to the volume that passes out of the auxiliary channel into the transfer channel during one revolution of the crankshaft. This ensures that after a supply of fuel into the auxiliary channel, all of the fuel passes out of the auxiliary channel into the transfer channel, thus avoiding a supply of fuel in the subsequent cycle, and enables a scavenging of the combustion chamber with largely fuel-free air. Due to the rotationally-precise metering of the fuel, it is possible to freely select the combustion model within limits. As a result, a uniform idling can be achieved. At the same time, a quiet running of the engine, especially during idling, is achieved, which leads to a reduced generation of noise.

If a check valve is disposed in the auxiliary channel, a flowing back of fuel/air mixture out of the crankcase into the auxiliary channel is avoided during full throttle operation of the internal combustion engine due to the high crankcase compression.

The intake channel and the auxiliary channel can be connected with the clean air chamber of an air filter. All of the combustion air required by the internal combustion engine is thus supplied not only via the intake channel but also via the auxiliary channel. The auxiliary channel is advantageously a separate channel. However, the auxiliary channel in the carburetor can branch off from the intake channel upstream of a flow control element disposed in the intake channel. The valve is disposed in the second fuel channel. A second valve is advantageously disposed in the region where the first fuel channel and the second fuel channel branch off from the common fuel channel portion. The valve advantageously controls the quantity of fuel supplied to the first fuel channel and to the second fuel channel. By means of the valve, the distribution of fuel to the first and the second fuel channels can be controlled. In this connection, the control of fuel can, for example, be effected as a function of the operating state of the internal combustion engine, so that for example during idling, fuel is supplied only via the auxiliary channel, and during full throttle fuel is supplied not only via the auxiliary channel but also via the intake channel. However, it would also be possible to supply fuel during full throttle only via the intake channel. Control of the valve can be effected such that during idling no fuel is supplied to the intake channel. In this connection, the first fuel channel is blocked. This ensures that no fuel can pass into the crankcase via the intake channel. During those revolutions during which no fuel is to be supplied via the auxiliary channel either, it is possible in this way to ensure that a scavenging of the combustion chamber with fuel-free air is effected.

A second valve is advantageously disposed in the second fuel channel. The second valve can control the supply of fuel to the auxiliary channel in such a way that fuel is not supplied during every revolution of the crankshaft. In this connection, the second valve can in particular be embodied as an electromagnetic valve, while the first valve can also be actuated mechanically. However, it can also be advantageous to embody both valves as valves that are to be actuated electromagnetically. However, both valves can also be actuated mechanically. A second valve is advantageously disposed in the auxiliary channel. By means of a second valve disposed in the auxiliary channel, it is also possible to control the supply of fuel.

The first and the second fuel channels advantageously branch off from a common fuel channel portion that is connected with the storage reservoir. The valve is advantageously disposed in the common fuel channel portion. As a result, the valve controls not only the supply of fuel to the intake channel, but also the supply of fuel to the auxiliary channel. In this way, it is easy to adapt the quantity of fuel supplied to the internal combustion engine to the operating state of the engine, for example to the speed thereof. To prevent the combustion air from being pressed into the second fuel channel, a check valve is disposed in the second fuel channel downstream of the valve. However, the valve can also be disposed in the auxiliary channel. As a result, the auxiliary channel, in other words the supply of fuel for idling, can be directly controlled by the valve. During cycles in which the combustion chamber is scavenged with fuel-free air, the valve is closed. Consequently, the scavenging losses that result due to the removal of the fuel wall film in the auxiliary channel can be reduced.

The second fuel channel advantageously opens out into the auxiliary channel immediately upstream of the transfer channel. In this connection, the opening-out is preferably upstream of the check valve in the auxiliary channel. By opening out in the immediate spatial vicinity of the transfer channel, there results only a short wall section of the auxiliary channel on which fuel can deposit. Also in this way scavenging losses that result due to the removal of the wall film in the auxiliary channel can be reduced.

In order to also ensure an adequate supply of fuel in the partial load range, the storage reservoir can be connected with the intake channel via a third fuel channel, whereby a flow control device is disposed in the third fuel channel. In this connection, the third fuel channel serves for the supply of fuel in the partial load range.

To achieve low exhaust gas or emission values, the internal combustion engine can have an air channel that supplies combustion air to at least one transfer channel. The air channel serves to temporarily store the combustion air, which is largely fuel-free or fuel poor. This fuel poor to fuel-free combustion air enters into the combustion chamber before fresh mixture can flow out of the crankcase into the combustion chamber. This temporarily stored scavenging air separates the exhaust gases in the combustion chamber from the fresh mixture that subsequently flows in. As a result, the fresh mixture is prevented from escaping directly out of the combustion chamber into the outlet. The intake channel is advantageously divided over at least one portion of its length into a mixture channel and the air channel. Thus, no separate channel is required for the air channel. Not only the mixture channel but also the air channel can be throttled by a common flow control element. A simple construction of the internal combustion engine thus results. The separation can, for example, be effected by means of a partition in the intake channel.

A method for operating an internal combustion engine having a combustion chamber that is delimited by a piston, whereby the piston drives a crankshaft rotatably mounted in a crankcase, and with at least one transfer channel that in prescribed positions of the piston fluidically connects the crankcase with the combustion chamber, and with an intake channel that opens into the crankcase and with an auxiliary channel that opens into the transfer channel, provides that during idling the internal combustion engine is supplied via the intake channel with largely fuel-free air, and during a first revolution of the crankshaft is supplied with fuel via the auxiliary channel, so that combustible mixture can form in the combustion chamber, and during a second revolution of the crankcase largely fuel-free air is supplied via the auxiliary channel and the combustion chamber is scavenged with largely fuel-free air.

Due to the fact that the internal combustion engine is scavenged during second revolutions with largely fuel-free air during idling, uncombusted fuel is prevented from being scavenged out of the combustion chamber. The scavenging losses are thereby reduced, and the fuel consumption and the exhaust gas values are thereby reduced. Since fuel is supplied during only prescribed revolutions, it is readily possible to control the number of combustions of the internal combustion engine during idling, so that a prescribed combustion model can be achieved. As a result, a quiet running of the engine is achieved, and the noise of the engine can be positively influenced.

First and second revolutions are advantageously carried out pursuant to a prescribed model. The supply of fuel via the auxiliary channel is in this connection in particular controlled in such a way that the number of first revolutions in a prescribed time interval consisting of a plurality of revolutions of the crankshaft is less than the number of second revolutions. Accordingly, more revolutions are carried out during which the combustion chamber is scavenged with largely fuel-free air. During idling, fuel is expediently supplied via the auxiliary channel during each second to each eighth revolution. During the interposed cycles, the combustion chamber is scavenged with largely fuel-free air. As a result of the auxiliary channel, this can be easily achieved. The quantity of fuel supplied to the internal combustion engine via the auxiliary channel is expediently controlled by a valve, whereby during first revolutions the valve is opened for a prescribed time span, and during second revolutions it remains closed. Via the control of the valve, it is thus possible to effect a control of the combustion model of the internal combustion engine. The fuel is advantageously supplied via the auxiliary channel as an enriched fuel/air mixture. Fuel is advantageously supplied to the internal combustion engine via only one of the channels during at least one operating state. In particular, during idling operation fuel is supplied only via the auxiliary channel. During full throttle operation, all of the fuel is advantageously supplied via the intake channel. During full throttle operation of the internal combustion engine, fuel/air mixture is supplied to the internal combustion engine not only via the intake channel but also via the auxiliary channel. However, it can also be advantageous to supply fuel/air mixture only via the intake channel during full throttle operation.

Due to the fact that the first fuel channel has a valve, a choke valve in the intake channel can be eliminated, since during start-up the entire supply of fuel is effected via the auxiliary channel. Since for the supply of fuel via the intake channel no great underpressure is required in the crankcase, a combustible mixture can very rapidly be made available during start-up, thus facilitating and accelerating the starting process.

Combustion air from an air channel is advantageously temporarily stored or collected in at least one transfer channel. In this connection, the temporarily stored combustion air is largely fuel-free or fuel poor. The amount of fuel in the air channel is less than the amount of fuel in the mixture channel. This combustion air separates the exhaust gases in the combustion chamber from fresh mixture that subsequently flows in, so that the fresh mixture cannot escape out of the combustion chamber along with the exhaust gases. As a result, the emission values of the internal combustion engine are improved.

Further specific features of the present application will be described in detail subsequently.

DESCRIPTION OF SPECIFIC EMBODIMENTS

Referring now to the drawings in detail, the internal combustion engine 1 schematically illustrated in FIG. 1 has a cylinder 2 in which a piston 8 is reciprocally mounted. The piston 8 delimits a combustion chamber 3 that is formed in the cylinder 2. By means of a connecting rod 9, the piston 8 drives a crankshaft 5 that is rotatably mounted in a crankcase 4. The internal combustion engine 1 has at least one transfer channel 6 that in the region of the lower dead center position of the piston 8 connects the crankcase 4 with the combustion chamber 3. The internal combustion engine 1 is embodied as a high-speed two-cycle engine and has a small piston displacement. The internal combustion engine 1 is preferably suitable for use in manually-guided or portable implements such as power saws, cut-off machines, brush cutters, or the like.

The internal combustion engine 1 has an intake channel 46 that opens out at an inlet 7 of the internal combustion engine. The inlet 7 opens into the crankcase 4 and is formed on the cylinder 2, so that the inlet 7 is port-controlled by the piston 8. An intake channel section 11 of the internal combustion engine 1 is formed in a carburetor 10. The intake channel section 11 has a venturi section 13 into which a main fuel opening 14 opens. Downstream from the venturi section 13, a butterfly valve 12 having a throttle shaft 42 is pivotably mounted in the intake channel section 11. An idling fuel opening 15 opens into the intake channel section 11 downstream of the main fuel opening 14 and upstream of the butterfly valve 12. The main fuel opening 14 is supplied via a first fuel channel 16. A check valve 18 is disposed in the fuel channel 16 upstream of the main fuel opening 14. The fuel flows in the first fuel channel 16 over a ring-gap 19. The ring-gap 19, the check valve 18, and the main fuel opening 14 are advantageously formed on a main fuel nozzle.

The first fuel channel 16 is connected with a storage reservoir 26 into which a fuel pump 31 conveys fuel. The storage reservoir 26 is connected with the fuel pump 31 via an inlet valve 30 upon which a spring 29 acts. The inlet valve 30 is connected via a lever connection 28 with a regulating diaphragm 27, which delimits the storage reservoir 26. As a function of the pressure in the storage reservoir 26, the lever connection 28 is actuated and the inlet valve 30 opens counter to the force of the spring 29. The storage reservoir 26 supplies the idling fuel opening 15 via a fuel channel 17 in which are disposed a check valve 32 and, downstream of the check valve, a flow control means 33.

The internal combustion 1 has an auxiliary channel 20, which is partially guided in the carburetor 10. The auxiliary channel 20 opens into the transfer channel 6 via an opening 47. The opening 47 is disposed approximately at the level of a transfer window 54, via which the transfer channel 6 opens into the combustion chamber 3. Upstream of the opening 47, the auxiliary channel 20 has a check valve 24. Upstream of the carburetor 10, the internal combustion engine 1 is provided with an air filter 44. The auxiliary channel 20 and the intake channel 46 open out at a clean air side or chamber 45 of the air filter 44, so that combustion air is supplied to the internal combustion engine 1 not only via the auxiliary channel 20 but also via the intake channel 46.

A second fuel channel 22 opens into the auxiliary channel 20 via a check valve 23 and a fuel opening 21. The second fuel channel 22 and the first fuel channel 16 are connected via a common channel portion 43 with the storage reservoir 26 for fuel. A valve 25 is disposed in the common channel portion 43. The valve 25 is in the form of an electrically actuatable valve, and is controlled by a control device 55.

The flow cross-section of the auxiliary channel 20 is considerably smaller than is the flow cross-section of the intake channel 46. The volume of the auxiliary channel 20 between the fuel opening 21 and the opening 47 into the transfer channel 6 is such that it corresponds at most to the volume that is drawn into the transfer channel 6 during one revolution of the crankshaft 5. This ensures that during a revolution of the crankshaft 5, the entire volume disposed downstream of the fuel opening 21 in the auxiliary channel 20 is drawn into the internal combustion engine 1.

The operation of the internal combustion engine 1 during idling will be explained in the following with the aid of FIGS. 2 to 5.

During operation, the crankshaft 5 rotates in the direction of the arrow 34. With the crankshaft position shown in FIG. 2, the piston 8 executes an upward stroke from the crankcase 4 to the combustion chamber 3. With the piston position showing in FIG. 2, the inlet 7 into the crankcase 4, and the transfer window 54 into the combustion chamber 3, are closed off by the piston 8. By means of the opening 47, largely fuel-free air, which is indicated by the arrow 36, is drawn out of the auxiliary channel 20 and into the transfer channel 6. The valve 25 in the common fuel channel portion 43 is opened, so that fuel can flow along in the direction of the arrow 35 into the auxiliary channel 20. Due to the low underpressure in the intake channel section 11, no fuel enters into the intake channel section via the main fuel opening 14 and the idling fuel opening 15 since the throttling effect of the flow control means 33 is too great.

Figure 3:
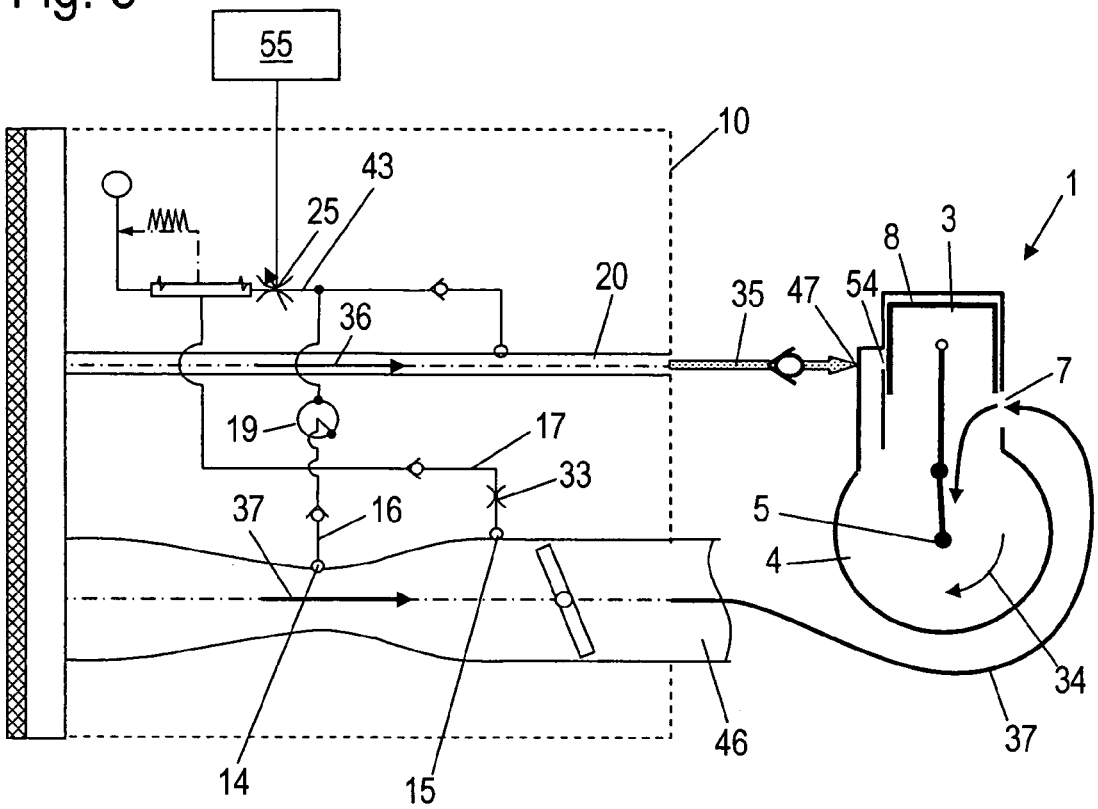

In FIG. 3, after further rotation of the crankshaft 5 in the direction of the arrow 34, the piston 8 is shown in the upper dead center position. In this position of the piston 8, the inlet 7 is opened to the crankcase 4, so that combustion air is drawn into the crankcase 4 via the intake channel 46 in the direction of the arrow 37. Small quantities of fuel can be mixed with the combustion air; however, preferably involved is extensively fuel-free combustion air. The fuel that flows in the auxiliary channel 20 in the direction of the arrow 35 is drawn in up to the region of the opening 47. The electrical valve 25 in the common channel portion 43 is closed, so that no further fuel flows into the auxiliary channel 20. Largely fuel-free air subsequently flows through the auxiliary channel 20 in the direction of the arrow 36 to the opening 47. Since in the previous cycle the combustion chamber 3 was flushed with largely fuel-free air, no combustion takes place in the combustion chamber 3 in the region of the upper dead center position of the piston 8.

Figure 4:
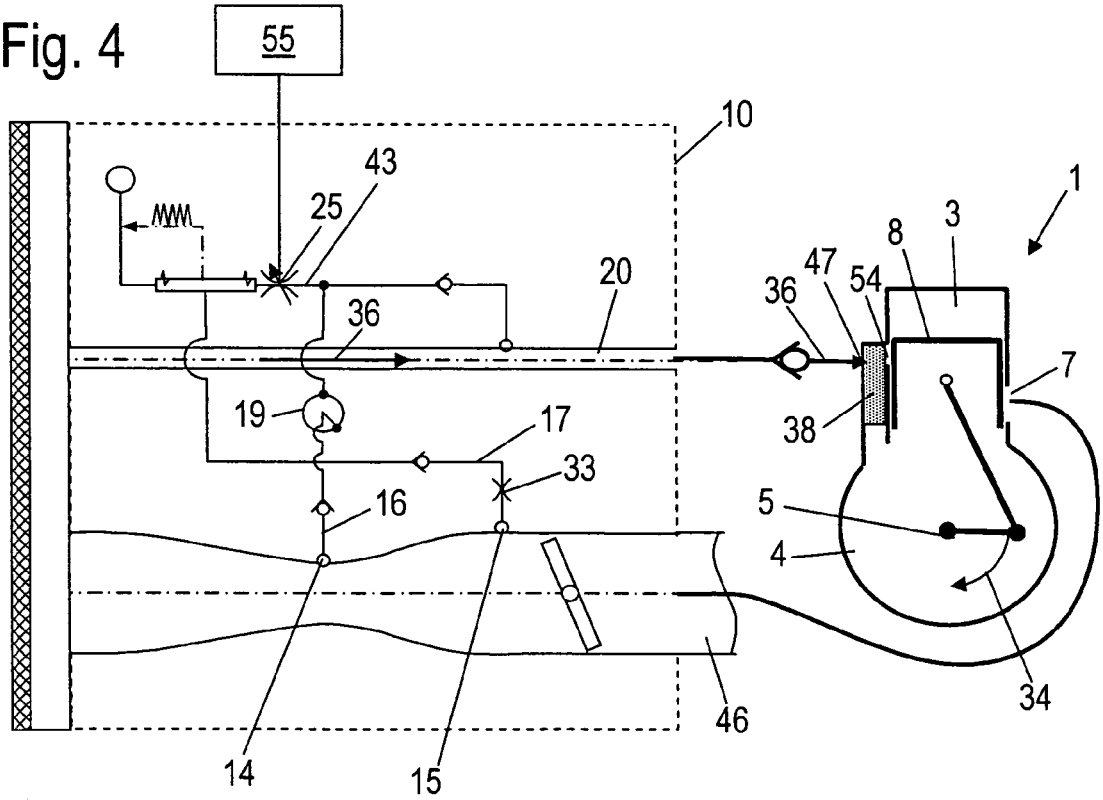

In FIG. 4, the internal combustion engine 1 is shown after further rotation of the crankshaft 5 in the direction of the arrow 34. The inlet 7 is closed off by the skirt of the piston 8, so that no further combustion air can be drawn out of the intake channel 46. The fuel from the auxiliary channel 20 has been drawn entirely into the transfer channel 6, and is disposed in the region 38 thereof. The preceding opening duration and opening time of the valve 25 were selected such that no fuel transferred out of the transfer channel 6 into the crankcase 4. The auxiliary channel 20 is entirely filled with largely fuel-free air. As a consequence of the check valve 24, fuel/air mixture is prevented from being pressed out of the region 38 back into the auxiliary channel 20.

Figure 5:
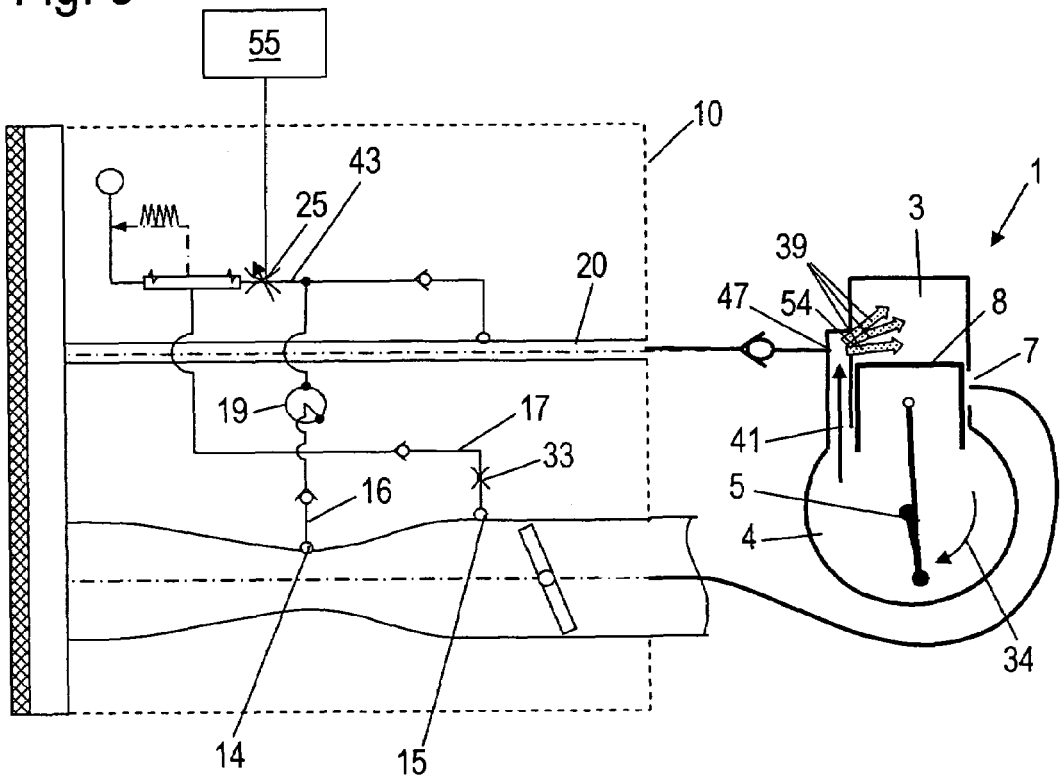

As shown in FIG. 5, during the further downward stroke of the piston 8, the transfer window 54 opens, so that the mixture can flow out of the region 38 into the combustion chamber 3 in the direction of the arrows 39. Largely fuel-free combustion air subsequently flows out of the crankcase 4 in the direction of the arrow 41. In the following upward stroke of the piston 8, the fuel/air mixture is compressed in the combustion chamber 3 and is ignited in the region of the upper dead center position of the piston. As a consequence of the subsequent combustion, the piston 8 is accelerated in the direction towards its lower dead center position. The valve 25 can remain closed, so that even in the following cycle a flushing of the combustion chamber 3 with largely fuel-free air is effected.

During full throttle operation, by controlling the valve 25 the fuel quantity that is supplied to the internal combustion engine 1 can be controlled. By means of the valve 25, fuel is supplied to the intake channel section 11 via the main fuel opening 14 and the idling fuel opening 15 as a function of the underpressure in the intake channel section. Fuel is also supplied to the internal combustion engine 1 via the fuel opening 21 that opens into the auxiliary channel 20. Thus, a supply of fuel/air mixture to the internal combustion engine 1 is effected not only via the auxiliary channel 20 but also via the intake channel 46. Due to the fact that the fuel/air mixture that is supplied via the intake channel 46 flows into the combustion chamber 3 via the crankcase 4, an adequate lubrication of the moving parts in the crankcase 4 is ensured.

Figure 2:
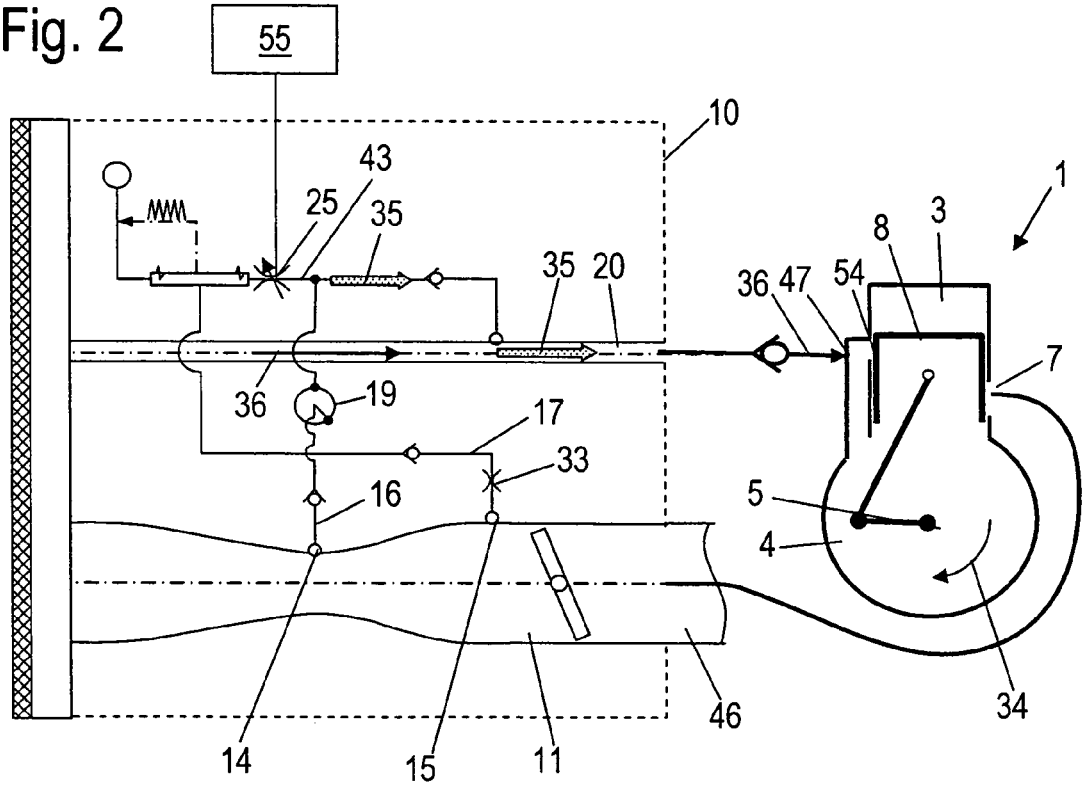
FIGS. 2 to 5 show the internal combustion engine of FIG. 1 at various points in time during a crankcase revolution.
Figure 6:
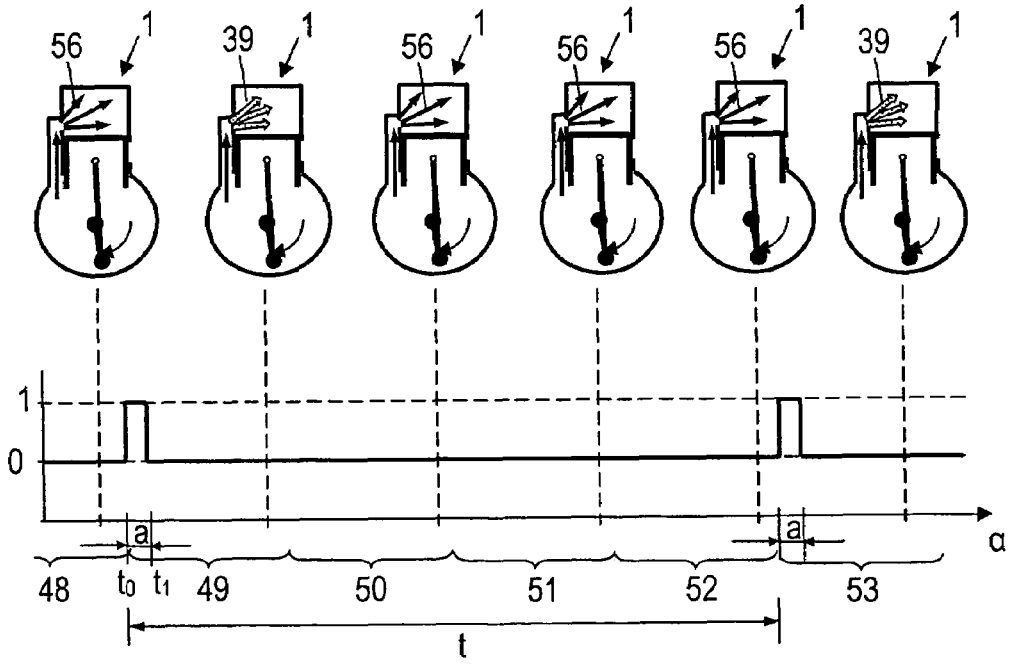
FIG. 6 is a graph of the control of the internal combustion engine of FIGS. 1 to 5 during idling.

FIG. 6 shows the operation of the internal combustion engine 1 during idling. The schematic illustrations of the internal combustion engine 1 make it clear at which revolutions of the crankshaft mixture 39 or largely fuel-free combustion air 56 flow into the combustion chamber. In the graph of FIG. 6, the state of the valve 25 is plotted over the crankcase angle $\alpha$. In this connection, "0" indicates the closed state, and "1" designates the open state of the valve 25. With the first illustrated revolution 48, the combustion chamber 3 is flushed with air 56. No combustion takes place. After the lower dead center position of the piston, for example after closing of the transfer window 54, the valve 25 opens at the point in time $t_o$ and closes at the point in time $t_1$. For the time span a between the point in time $t_o$ and $t_1$ the valve 25 is accordingly open and the fuel flows into the auxiliary channel 20 as shown in FIG. 2. With the preceding revolution 48, no combustion takes place in the combustion chamber, since no fuel was supplied to the internal combustion engine 1. With the revolution 49, fuel is drawn into the transfer channel 6 via the auxiliary channel 20 and enters the combustion chamber 3 in the direction of the arrows 39. A combustible mixture can thereby form in the combustion chamber 3, so that in the upper dead center position of the piston a combustion can take place.

During the following three revolutions 50, 51 and 52, there is no supply of fuel. No fuel is supplied to the combustion chamber 1 either via the auxiliary channel 20 nor via the intake channel 46, so that the combustion chamber 3 is flushed with largely fuel-free air 56. No combustion takes place in the region of the upper dead center position of the piston 8. With the subsequent revolution 53, a valve 25 again opens for the time span a, so that fuel can enter into the auxiliary channel 20 and can be supplied to the transfer chamber 6. With the revolution 53, there is thus effected a transfer of fuel/air mixture 39 into the combustion chamber 3, so that a combustible mixture can form. The internal combustion engine thus executes first revolutions of the crankshaft during which fuel is supplied, as well as second revolutions during which no fuel is supplied.

In the illustrated embodiment, each fourth revolution of the crankshaft 5 effects a supply of fuel and hence a combustion in the combustion chamber 3. During the three revolutions of the crankshaft interposed therebetween, the combustion chamber is flushed with largely fuel-free air. During the time interval t that includes four revolutions of the crankshaft 5, fuel is thus supplied during one of the revolutions, while no fuel is supplied during three revolutions.

Fuel is advantageously supplied at each second to each eighth revolution of the crankcase. In this connection, the fuel supply is in particular effected pursuant to a prescribed model, which can be adapted with the aid of the measured speed. The fuel supply can also be effected pursuant to a stochastic model, so that the generation of vibrations by the internal combustion engine are reduced. The fuel is supplied over the auxiliary channel 20 in the form of enriched fuel/air mixture. During full throttle operation, fuel is supplied during each revolution of the crankshaft.

Figure 7:
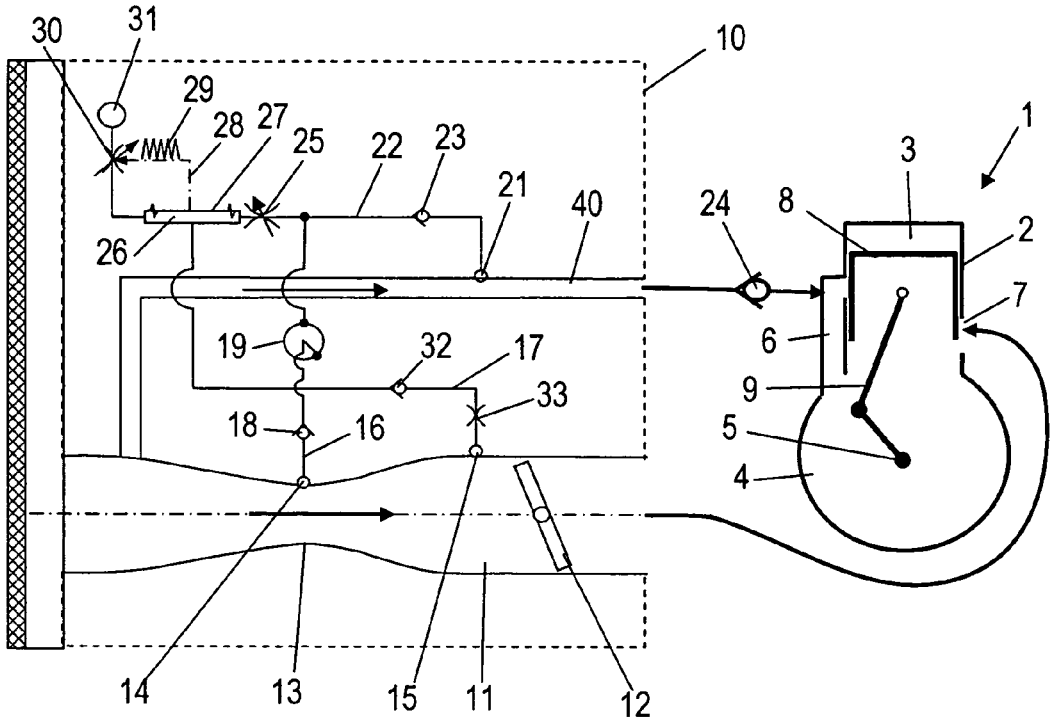
FIGS. 7 to 16 show embodiments of the internal combustion engine of FIGS. 1 to 5.

FIG. 7 illustrates an embodiment of the internal combustion engine 1 that essentially corresponds to the internal combustion engine shown in FIGS. 1 to 5. The same reference numerals designate the same components. The carburetor 10 has an auxiliary channel 40 that opens into the transfer channel 6. The auxiliary channel 20 is not connected directly with the air filter 44, but rather opens out into the intake channel section 11 upstream of the butterfly valve 12 and upstream of the venturi section 13. However, the auxiliary channel 20 can also branch off from the intake channel section 11 downstream of the venturi section 13 and upstream of the butterfly valve 12.

Figure 8:
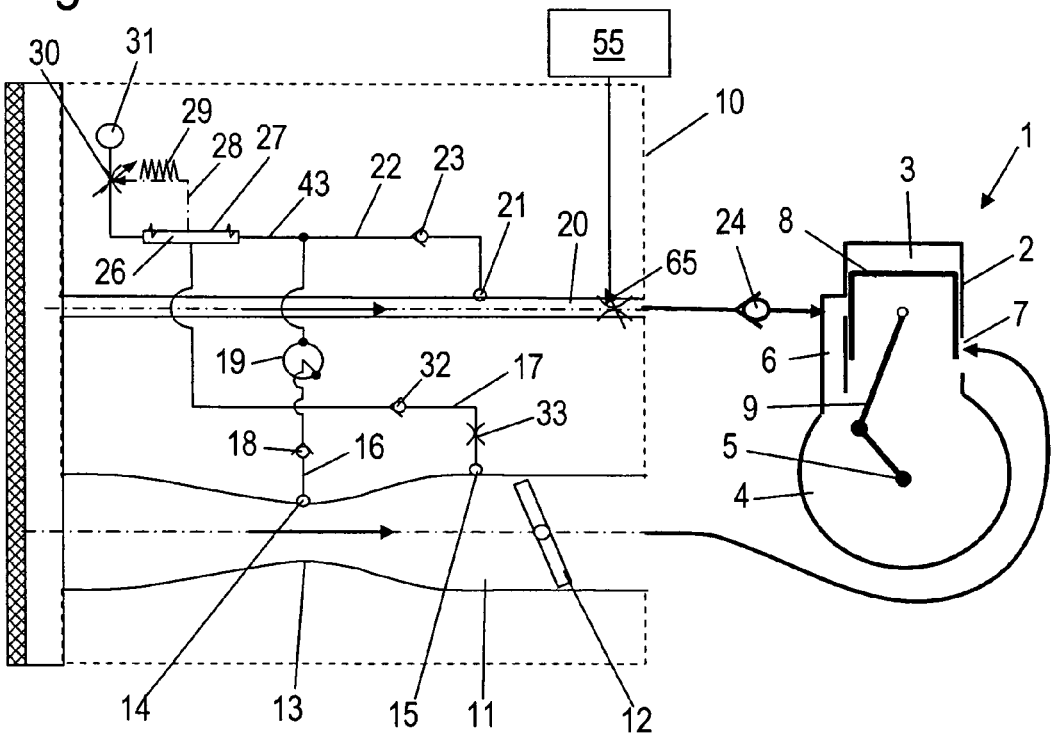

The internal combustion engine 1 illustrated in FIG. 8 also corresponds essentially to the internal combustion engine of FIGS. 1 to 5. In this embodiment, however, the valve 65 that controls the quantity of fuel supplied to the internal combustion engine 1 is not disposed in the second fuel channel 22, but rather directly in the auxiliary channel 20. The valve 25 is preferably an electromagnetic valve. The valve 65 directly controls the quantity of fuel/air mixture supplied through the transfer channel 6, and hence indirectly also controls the fuel quantity supplied via the auxiliary channel 20. During idling, during cycles in which the combustion chamber 3 is flushed with fuel-free air, the valve 65 is closed. Due to the fact that the valve 65 is disposed directly in the auxiliary channel 20, there is effected in these cycles, via the auxiliary channel 20, neither a supply of fuel nor a supply of combustion air to the internal combustion engine 1. This prevents a wall film of fuel in the auxiliary channel 20 from being removed by the combustion air supplied during idling and being supplied to the internal combustion engine 1. The scavenging losses during idling can thereby be further reduced. In the embodiment of FIG. 8, the valve 65 is disposed in the carburetor 10 downstream of the fuel opening 21.

Figure 9:
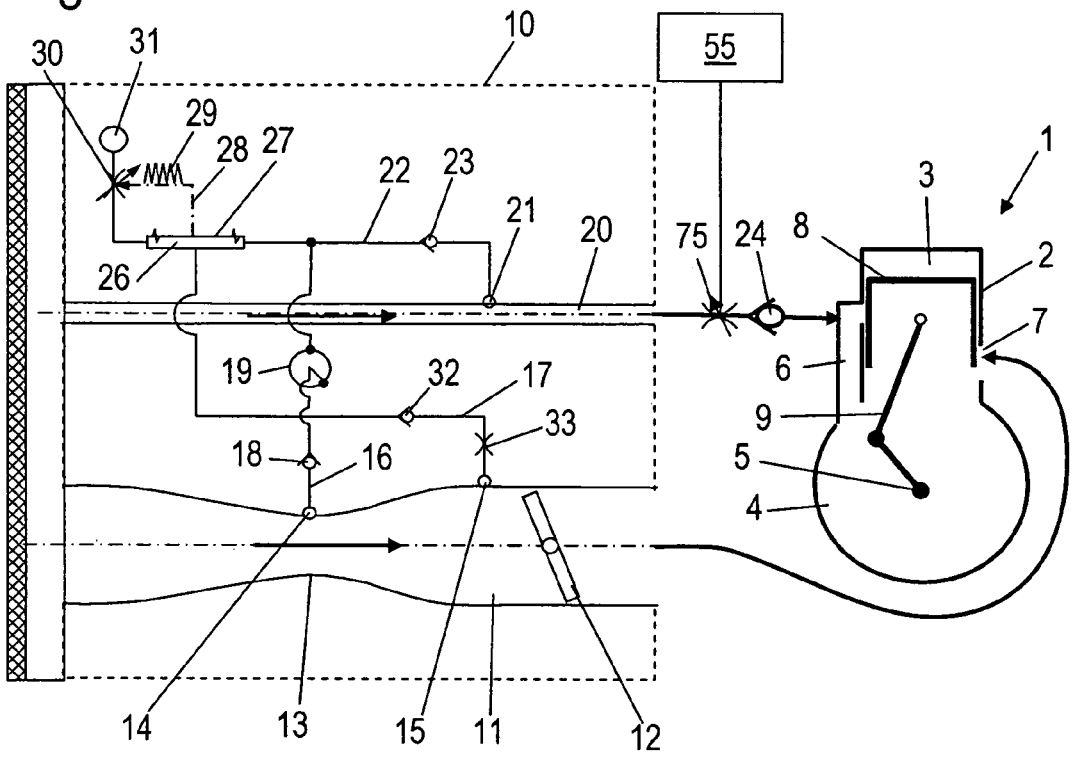

In the embodiment of FIG. 9, the valve 75 is also disposed in the auxiliary channel 20. However, the valve 75 is not disposed in the carburetor 10, but rather downstream of the carburetor immediately upstream of the check valve 24 in the auxiliary channel 20. Thus, the valve 75 is also disposed immediately upstream of the transfer channel 6. As a result, the channel length between the valve 75 and the transfer channel 6 is minimized, thus also minimizing the wall surface on which fuel can be deposited. With the valve 75 closed, at most minimal quantities of fuel can pass into the combustion chamber 3. As a result, the scavenging losses during idling can be reduced still further. In other respects, the construction of the internal combustion engine 1 and of the carburetor 10, as well as the operation thereof, correspond to the embodiments of FIGS. 1 to 5.

Figure 10:
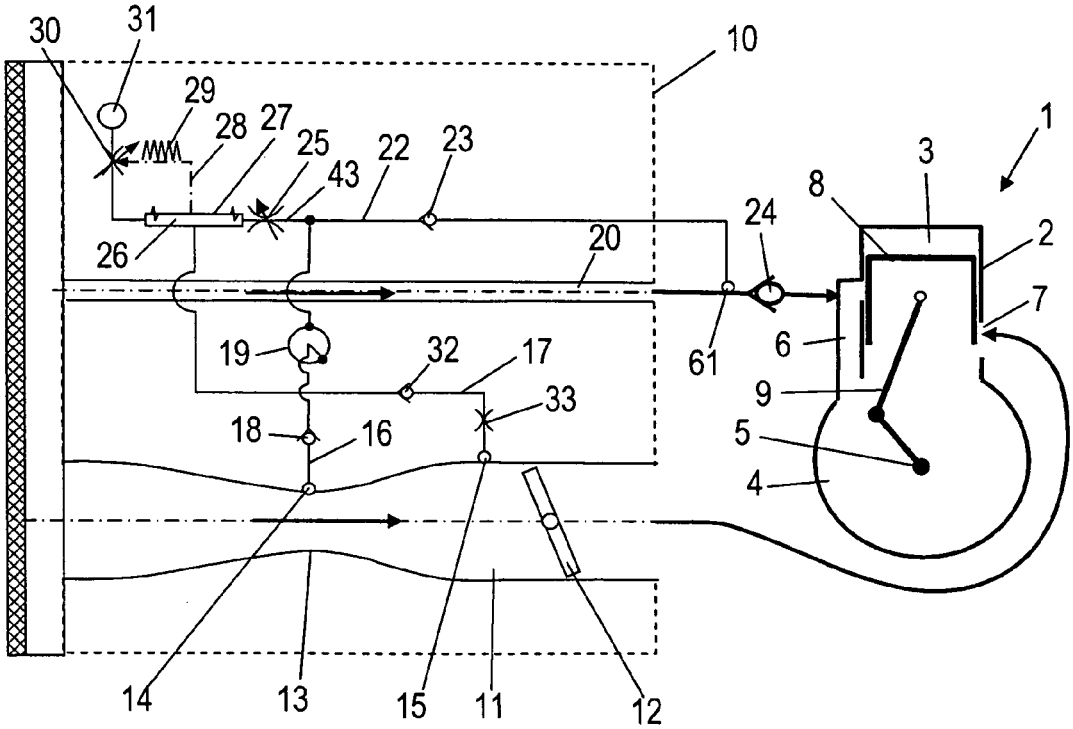

A further embodiment of an internal combustion engine 1 is illustrated in FIG. 10. This embodiment also essentially corresponds in construction and function to the embodiment of FIGS. 1 to 5. With the embodiment of FIG. 10, the valve 25 is disposed in the common fuel channel portion 43 of the first fuel channel 16 and of the second fuel channel 22. However, the second fuel channel 22 does not open into the auxiliary channel 20 in the carburetor 10, but rather downstream of the carburetor. The fuel channel 22 opens into the auxiliary channel 20 directly upstream of the transfer channel 6 and of the check valve 24 via a fuel opening 61. Due to the fact that the fuel opening 61 is disposed in the immediate spatial vicinity of the transfer channel 6, the channel length of the auxiliary channel 20 that is to be wetted with fuel is minimized, so that the quantity of fuel that can be deposited upon the walls of the auxiliary channel 20, and which can be carried along into the combustion chamber 3 during idling, is minimized. The scavenging losses during idling can thereby be further reduced.

Figure 11:
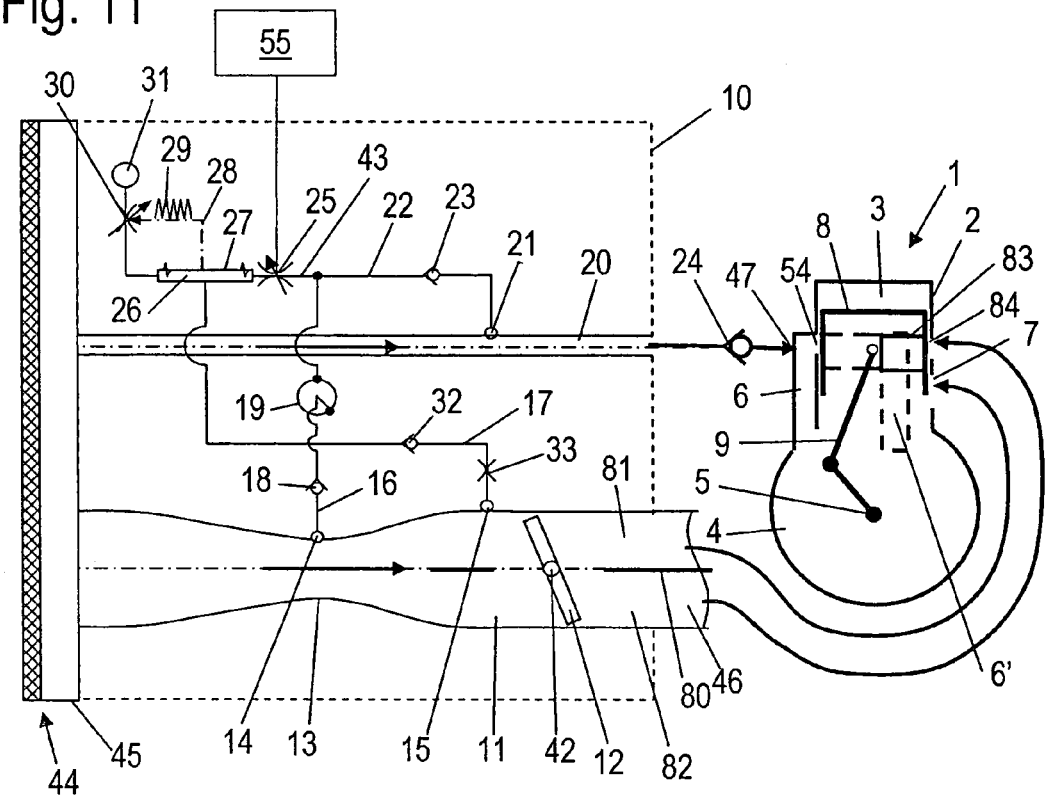
Figure 12:
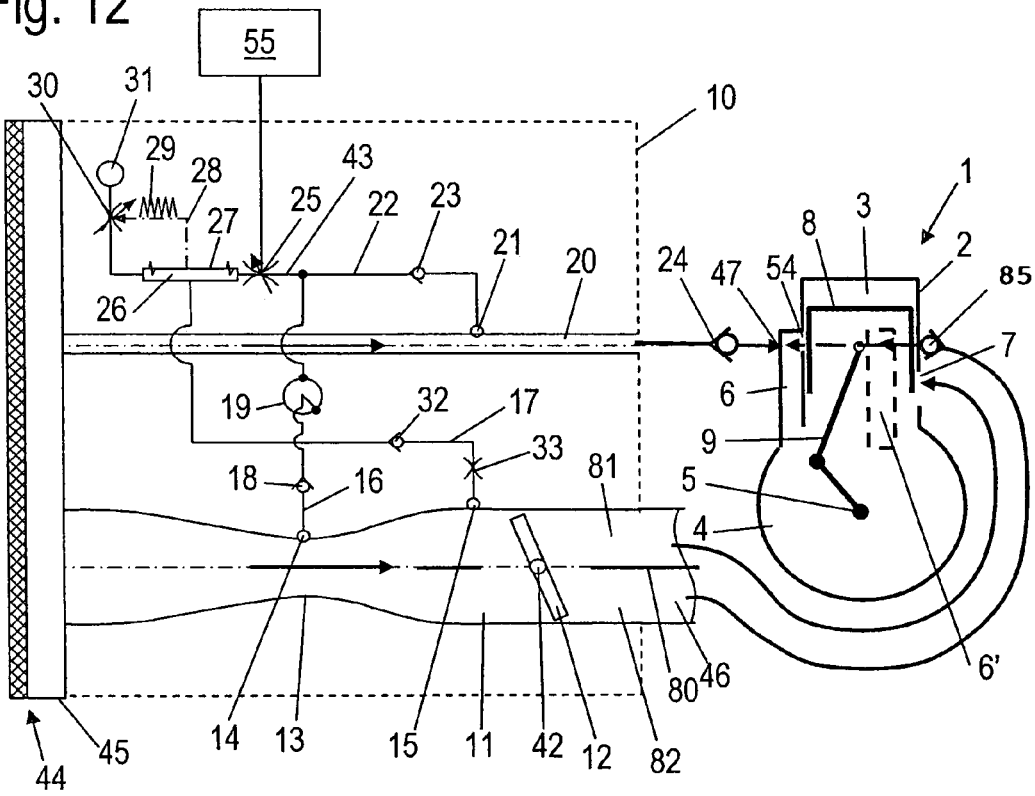

Further embodiments of an internal combustion engine 1 are illustrated in FIGS. 11 and 12. With these embodiments, the intake channel 46 is divided into a mixture channel 81 and an air channel 82. For this purpose, a partition 80 is disposed in the carburetor 10 in the region of the butterfly valve 12. The idling fuel opening 15 opens into the mixture channel 81. The partition 80 can also extend into the region of the main fuel opening 14. The intake channel 46 could also be divided over its entire length, up to the air filter 44, into the mixture channel 81 and the air channel 82. However, it can also be advantageous for the separation into the mixture channel 81 and the air channel 82 to be effected first downstream of the carburetor 10. The air channel 82 conveys largely fuel-free air, or a fuel/air mixture, the fuel content of which, in at least one operating state of the internal combustion engine 1, is less than the fuel portion of the mixture channel 81. In particular during full throttle, the mixture channel 81 and the air channel 82 are separated by the butterfly valve 12, so that only slight quantities of fuel can pass to the internal combustion engine 1 via the air channel 82.

In the embodiment of FIG. 11, the air channel 82 opens out at the cylinder 2 via a channel inlet 84. This inlet is disposed in a region of the cylinder 2 that is closed off by the piston 8 in every position of the piston. The piston 8 has a piston pocket 83 that in the region of the upper dead center position of the piston 8 connects the channel inlet 84 with a transfer channel 6'. A plurality of piston pockets 83 could also be provided that connect a plurality of transfer channels with the air channel 82. A single piston pocket 83 can also establish a flow connection to a plurality of transfer channel 6, 6'. An air channel 82 can also open out into the transfer channel 6 into which the auxiliary channel 20 opens. The design of a piston pocket 83 that connects the air channel 82 not only with the transfer channel 6' but also with the transfer channel 6 is indicated by dashed lines in FIG. 11.

During operation of the internal combustion engine 1, largely fuel-free or fuel-poor combustion air is temporarily collected in the transfer channel 6, 6' via the air channel 82 and the piston pocket 83. As soon as the piston 8 opens the transfer window 54 to the combustion chamber 3, first the temporarily collected, largely fuel-free or fuel-poor combustion air flows into the combustion chamber 3 and scavenges exhaust gases out of the combustion chamber 3. Subsequently, fresh fuel/air mixture flows out of the transfer channel 6 and/or out of the crankcase 4 into the combustion chamber 3.

In the embodiment of FIG. 12, the air channel 82 opens into the transfer channel 6' via a check valve 85. The connection between the air channel 82 and the transfer channel 6' is controlled in the embodiment of FIG. 12 by the pressure in the transfer channel 6' or in the crankcase 4. The manner of operation of the internal combustion engine 1 of FIG. 12 corresponds to that of the internal combustion engine 1 of FIG. 11. The connection of the air channel 82 also with the transfer channel 6 is indicated by dashed lines in FIG. 12. The transfer channel 6, 6' can be connected with the air channel 82 via a common check valve 85; however, a separate check valve 85 can also be provided for each of the transfer channels 6, 6'.

The air channel 82 can also be provided as a separate channel. It is then not necessary to divide the intake channel 46. A flow control element is advantageously disposed in the additional air channel, the position of which is coupled to the position of the butterfly valve 12.

Figure 13:
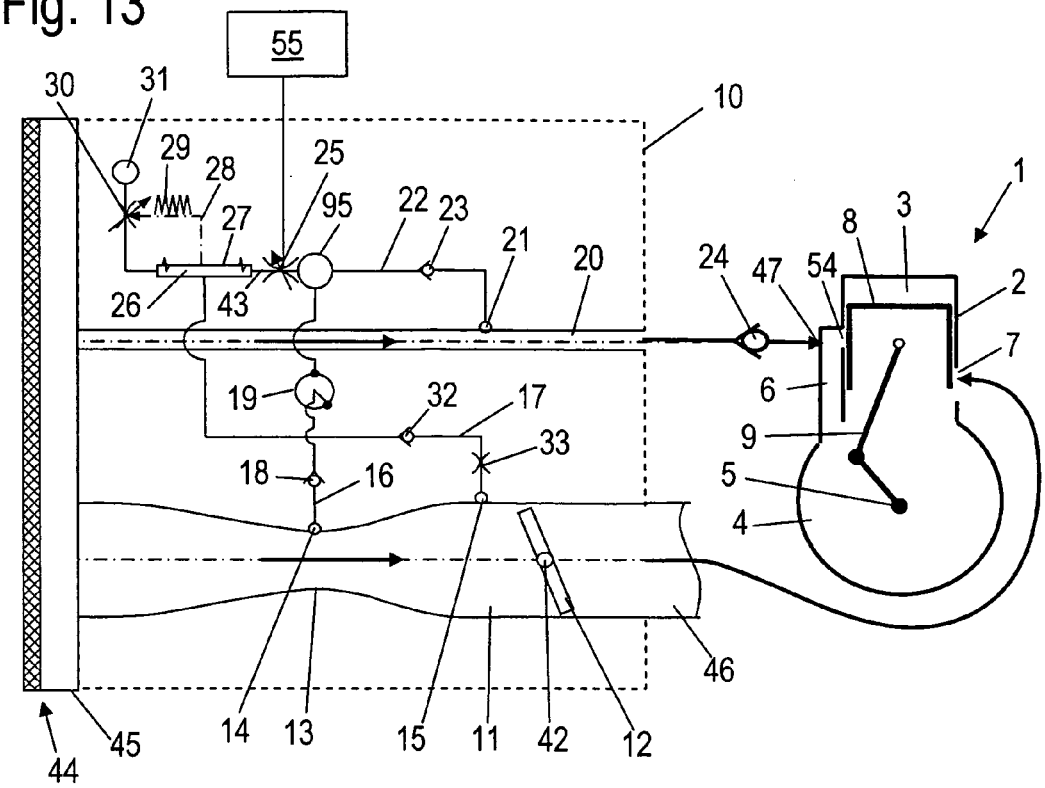

In the embodiment illustrated in FIG. 13, a first valve 25 is disposed in the common fuel channel portion 43. The first valve 25 controls the quantity of fuel that on the whole is to be supplied to the internal combustion engine. The first valve 25 is embodied as a valve that is to be electromagnetically actuated, and is controlled by a control device 55. Downstream of the first valve 25, in the region where the first fuel channel 16 and the second fuel channel 22 branch off, a second valve 95 is disposed. The second valve 95 controls the distribution of the fuel to the first fuel channel 16 and to the second fuel channel 22. In this connection, the second valve 95 can entirely block either the fuel supply into the first fuel channel 16 or into the second fuel channel 22, so that fuel is supplied to the internal combustion engine 1 via only the auxiliary channel 20 or only via the intake channel 46. A control or connection state of the valve 95 is also possible where fuel can be supplied into both of the fuel channels 16 and 22.

During operation of the internal combustion engine 1, the first valve 25 controls the quantity of fuel that as a whole is to be supplied to the internal combustion engine 1 as a function of the operating state of the engine. The second valve 95 is advantageously embodied as a mechanically actuatable valve, and controls the distribution of fuel to the two fuel channels 16 and 22 as a function of at least one operating parameter of the internal combustion engine 1. The second valve 95 can in particular be formed by transverse bores or recesses on the throttle shaft 42. The supply of fuel to the first fuel channel 16 and to the second fuel channel 22 is then effected as a function of the position of the butterfly valve 12, in other words, as a function of the load of the internal combustion engine 1. Instead of the second valve 95, it would also be possible to provide a further valve that is to be electromagnetically actuated.

During idling operation, the second valve 95 conveys the entire fuel to the second fuel channel 22, so that the entire quantity of fuel that is to be supplied to the internal combustion engine 1 is conveyed via the auxiliary channel 20. During full throttle operation, the second valve 95 can supply fuel not only to the first fuel channel 16 but also to the second fuel channel 22, so that fuel is supplied not only via the intake channel 46 but also via the auxiliary channel 20. However, the second fuel channel 22 can also be blocked so that the entire quantity of fuel that is to be supplied to the internal combustion engine 1 passes to the engine via the intake channel 46. The first valve 25 corresponds to the first valve 25 showing in FIGS. 1 to 5, and is controlled in a corresponding manner.

Figure 14:
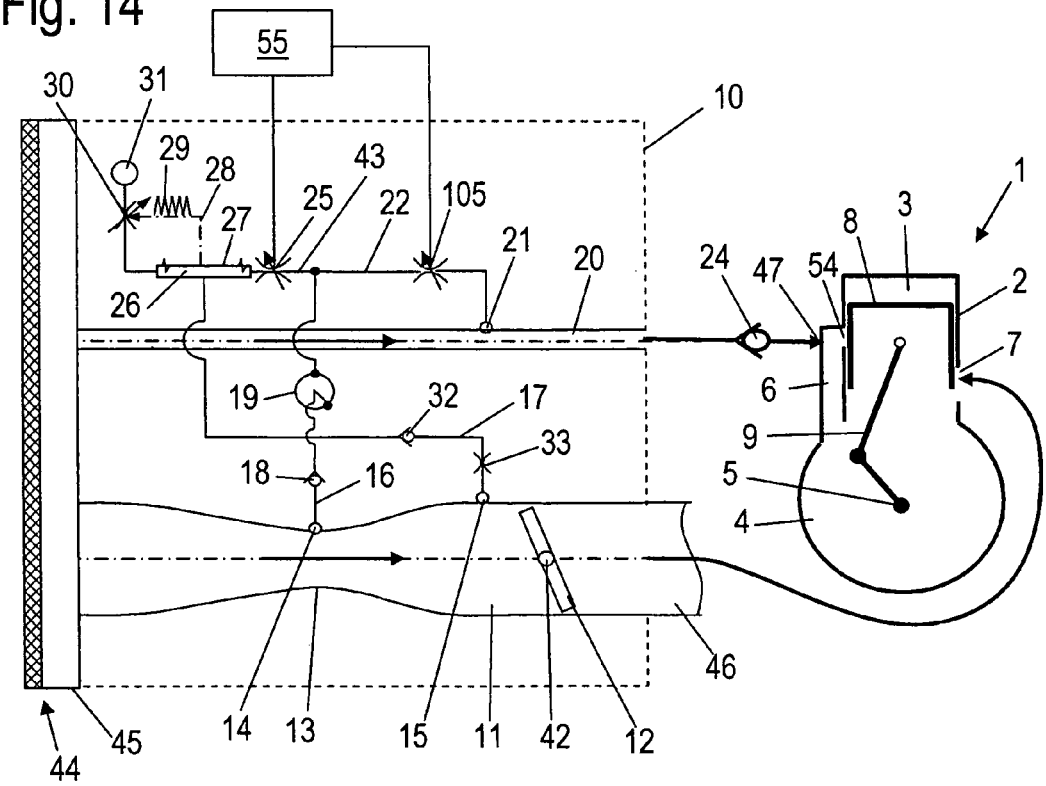

FIG. 14 shows a further embodiment. A first valve 25, which also corresponds to the fuel valve 25 showing in FIGS. 1 to 5, is disposed in the common channel portion 43. The fuel valve 25 is electrically actuated by a control device 55, and is controlled in the manner described in FIGS. 1 to 6. Disposed downstream of the first valve 25, in the second fuel channel 22, is a second valve 105 that is also in the form of a valve that is to be electrically actuated and that is controlled by the control device 55. The entire quantity of fuel that is to be supplied to the internal combustion engine 1 is controlled by the first valve 25, while the second valve 105 controls which quantity of fuel passes to the internal combustion engine 1 via the auxiliary channel 20.

One of the valves 25 and 105 could be embodied as a valve that is to be actuated mechanically, and in particular one that is controlled as a function of an operating parameter of the internal combustion engine 1. If the first valve 25 is embodied as a valve that is to be actuated mechanically, the first valve 25 determines the overall quantity of fuel that is to be supplied to the internal combustion engine 1. The second valve 105 opens and closes the second fuel channel 22 at predetermined revolutions of the crankshaft 5 at which fuel is to be supplied via the auxiliary channel 20. In this case, the second valve 105 opens and closes at those points in time described in FIGS. 1 to 5 for valve 25.

However, the second valve 105 can also be provided as a valve that is to be actuated mechanically. In this case, the first valve 25 is opened and closed as described in FIGS. 1 to 6. The second valve 105 is completely open during idling operation, so that the entire quantity supply of fuel is supplied via the auxiliary channel 20. During full throttle operation, the second valve 105 is closed, so that the entire quantity of fuel is supplied via the intake channel 46. However, the second valve 105 can also be partially open during full throttle operation, so that a certain quantity of fuel is also supplied via the auxiliary channel 20 during full throttle operation.

Figure 15:
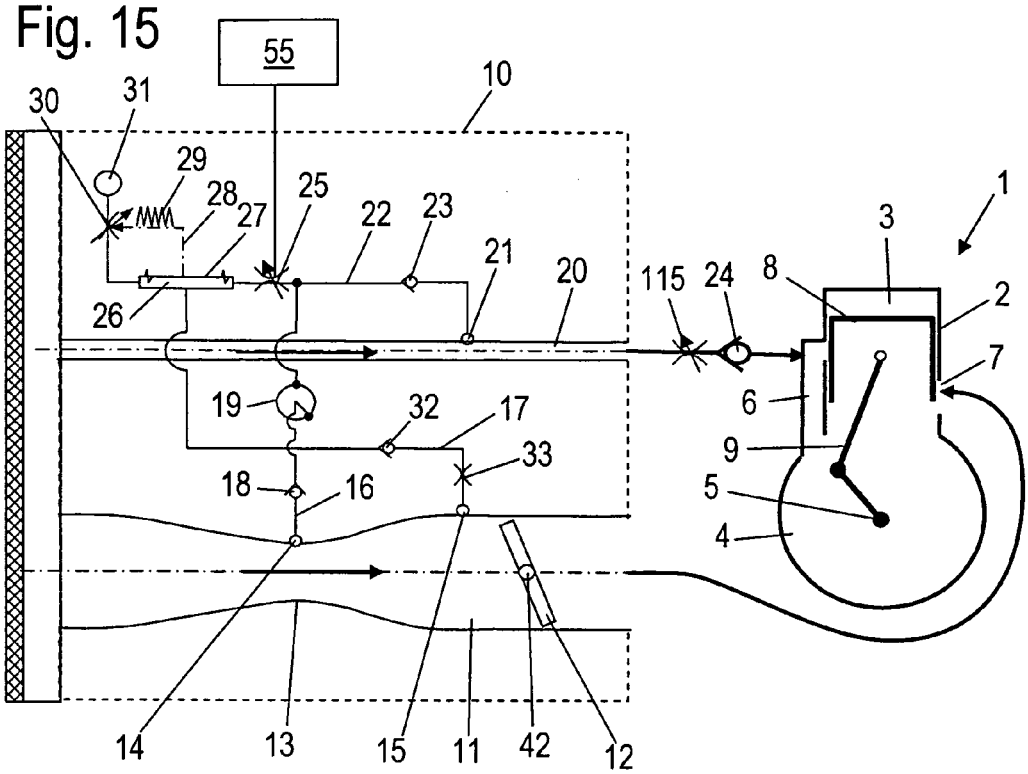

The embodiment illustrated in FIG. 15 essentially corresponds to the embodiment of FIG. 14. However, a second valve 115 is disposed not in the second fuel channel 22, but rather directly in the auxiliary channel 20. The second valve 115 controls the quantity of fuel/air mixtures supplied to the transfer channel 6 from the auxiliary channel 20. The second valve 115 can be embodied as a valve that is to be actuated mechanically, and can, for example, be controlled by the throttle shaft 42 of the butterfly valve 12.

Figure 16:
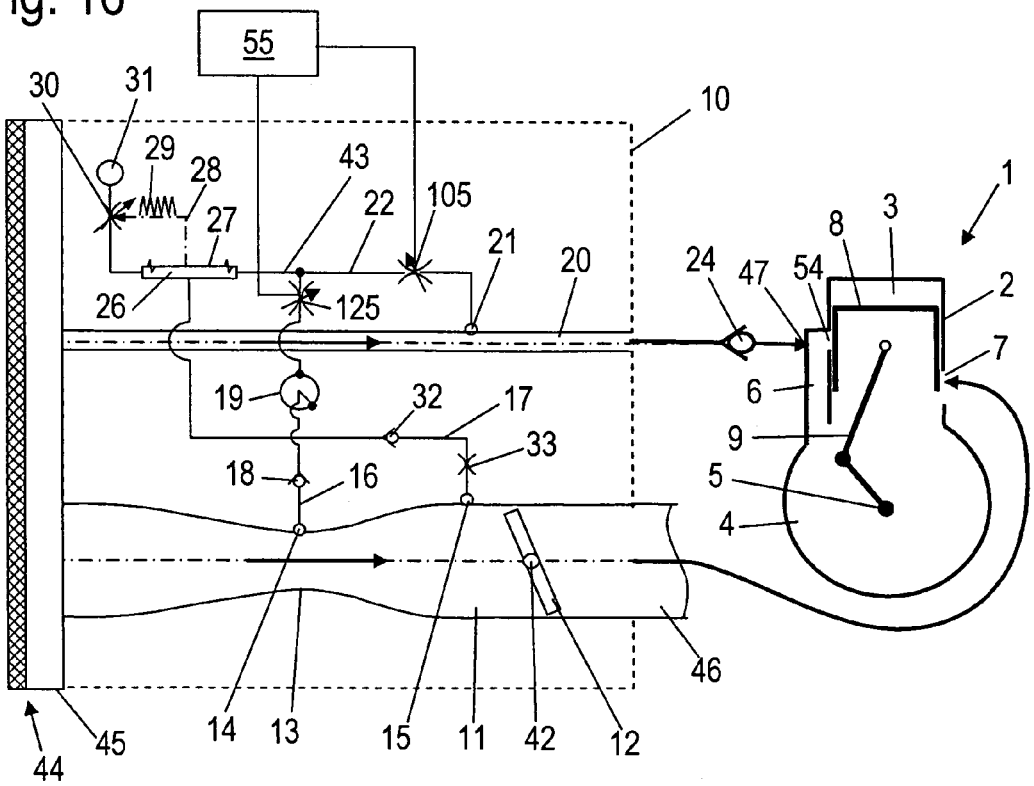

A further embodiment is illustrated in FIG. 16. In this embodiment, two valves 105 and 125 are illustrated that are to be actuated electrically. The first valve 125 is disposed in the first fuel channel 16 and controls the quantity of fuel that is to be supplied to the intake channel 46. A second valve 105 is disposed in the second fuel channel 22 and controls the quantity of fuel that is to be supplied to the auxiliary channel 20. By means of the two valves 105 and 125, it is possible to essentially freely control in which operating state, and via which channel, which quantity of fuel is to be supplied. During idling, the entire quantity of fuel is advantageously supplied via the auxiliary channel 20. In the operating state, the first valve 125 is closed and the second valve 105 is opened. During partial load, both of the valves 125, 105 can be partially or entirely opened. The two valves 105 and 125 can also be entirely opened during full throttle, so that during full throttle fuel is supplied not only via the auxiliary channel 20 but also via the intake channel 46. However, during full throttle the second valve 105 could also be closed, and the entire part of the fuel that is to be supplied can be supplied via the intake channel 46. During idling, the second valve 105 is controlled in such a way that fuel is not supplied during every revolution of the crankshaft 5. The fuel supply is effected in a cyclical manner as described in conjunction with FIGS. 1 to 6.

The specification incorporates by reference the disclosure of German priority document 10 2005 037 928.1 filed Aug. 11, 2005.

The present invention is, of course, in no way restricted to the specific disclosure of the specification and drawings, but also encompasses any modifications within the scope of the appended claims.

What we claim is:

1. An internal combustion engine, comprising:

a cylinder having a combustion chamber that is delimited by a piston reciprocally mounted in the cylinder, wherein said piston drives a crankshaft that is rotatably mounted in a crankcase, and wherein at least one transfer channel fluidically connects the crankcase with the combustion chamber in prescribed positions of said piston;

an intake channel that opens into said crankcase, wherein a first fuel channel opens into said intake channel and is adapted to supply fuel to said intake channel as a function of an underpressure in said intake channel, and wherein during an idling operation of said engine said intake channel is adapted to receive largely fuel-free air;

an auxiliary channel that opens into said at least one transfer channel, wherein a second fuel channel opens into said auxiliary channel and is connected to a storage reservoir for fuel; and at least one valve for controlling a quantity of fuel to be supplied to said internal combustion engine via said auxiliary channel wherein during said idling operation supply of fuel to said engine is adapted to be effected essentially via said auxiliary channel.

2. An internal combustion engine according to claim 1, wherein a carburetor is provided, wherein said intake channel has an intake channel section that is formed in said carburetor, and wherein said first fuel channel opens into said intake channel section in the vicinity of a venturi section.

3. An internal combustion engine according to claim 2, wherein said auxiliary channel is a separate channel, or wherein said auxiliary channel branches off from said intake channel in said carburetor upstream of a flow control element disposed in said intake channel.

4. An internal combustion engine according to claim 1, wherein said valve is electrically actuatable, or wherein said valve is mechanically actuatable.

5. An internal combustion engine according to claim 1, wherein a volume of said auxiliary channel between where said second fuel channel opens into said auxiliary channel, and where said auxiliary channel opens into said at least one transfer channel, corresponds at most to a volume that during one revolution of said crankshaft passes out of said auxiliary channel into said at least one transfer channel.

6. An internal combustion engine according to claim 1, wherein a check valve is disposed in said auxiliary channel.

7. An internal combustion engine according to claim 1, wherein said intake channel and said auxiliary channel are connected with a clean air chamber of an air filter.

8. An internal combustion engine according to claim 1, wherein said at least one valve is disposed in said second fuel channel.

9. An internal combustion engine according to claim 8, wherein a check valve is disposed in said second fuel channel downstream of said at least one valve.

10. An internal combustion engine according to claim 1, wherein said at least one valve is disposed in said auxiliary channel.

11. An internal combustion engine according to claim 1, wherein said second fuel channel opens into said auxiliary channel immediately upstream of said at least one transfer channel.

12. An internal combustion engine according to claim 1, wherein a check valve is disposed in said first fuel channel.

13. An internal combustion engine according to claim 1, wherein said storage reservoir is connected with said intake channel via a third fuel channel, and wherein a flow control device is disposed in said third fuel channel.

14. An internal combustion engine, comprising:

a cylinder having a combustion chamber that is delimited by a piston reciprocally mounted in the cylinder, wherein said piston drives a crankshaft that is rotatable mounted in a crankcase, and wherein at least one transfer channel fluidically connects the crankcase with the combustion chamber in prescribed positions of said piston;

an intake channel that opens into said crankcase, wherein a first fuel channel opens into said intake channel and is adapted to supply fuel to said intake channel as a function of an underpressure in said intake channel;

an auxiliary channel that opens into said at least one transfer channel, wherein a second fuel channel opens into said auxiliary channel and is connected to a storage reservoir for fuel;

at least one valve for controlling a quantity of fuel to be supplied to said internal combustion engine via said auxiliary channel; and a common fuel channel portion connected to said storage reservoir, wherein said first fuel channel and said second fuel channel branch off from said common fuel channel portion, and wherein said at least one valve is disposed in said common fuel channel portion.

15. An internal combustion engine according to claim 14, wherein a second valve is disposed in a region where said first fuel channel and said second fuel channel branch off from said common fuel channel portion, and wherein said second valve controls the quantity of fuel supplied to said first fuel channel and to said second fuel channel.

16. An internal combustion engine according to claim 14, wherein a second valve is disposed in said second fuel channel, or wherein a second valve is disposed in said auxiliary channel.

17. An internal combustion engine, comprising:

a cylinder having a combustion chamber that is delimited by a piston reciprocally mounted in the cylinder, wherein said piston drives a crankshaft that is rotatable mounted in a crankcase, and wherein at least one transfer channel fluidically connects the crankcase with the combustion chamber in prescribed positions of said piston;

an intake channel that opens into said crankcase, wherein a first fuel channel opens into said intake channel and is adapted to supply fuel to said intake channel as a function of an underpressure in said intake channel;

an auxiliary channel that opens into said at least one transfer channel, wherein a second fuel channel opens into said auxiliary channel and is connected to a storage reservoir for fuel;

at least one valve for controlling a quantity of fuel to be supplied to said internal combustion engine via said auxiliary channel; and in addition to said auxiliary channel, an air channel that is adapted to convey combustion air to said at least one transfer channel.

18. An internal combustion engine according to claim 17, wherein said intake channel is divided over at least a portion of its length into a mixture channel and said air channel.

19. A method of operating an internal combustion engine having a combustion chamber that is delimited by a piston reciprocally mounted in a cylinder, wherein said piston drives a crankshaft that is rotatably mounted in a crankcase, wherein at least one transfer channel fluidically connects said crankcase with said combustion chamber in prescribed positions of said piston, wherein an intake channel opens into said crankcase, and wherein an auxiliary channel (20, 40) opens into said at least one transfer channel, said method including the steps of:

supplying largely fuel-free air to said internal combustion engine via said intake channel during an idling operation, wherein during a first revolution of said crankshaft, fuel is supplied via said auxiliary channel, so that a combustible mixture can form in said combustion chamber, and wherein during a second revolution of said crankshaft largely fuel-free air is supplied via said auxiliary channel and largely fuel-free combustion air subsequently flows out of said crankcase into said combustion chamber, so that said combustion chamber is scavenged with largely fuel-free air.

20. A method according to claim 19, wherein said first revolutions and said second revolutions are carried out according to a prescribed model.

21. A method according to claim 19, which includes the step of controlling the supply of fuel via said auxiliary channel in such a way that the number of first revolutions in a prescribed interval (t), which includes a plurality of revolutions of said crankshaft, is less than the number of the second revolutions.

22. A method according to claim 21, wherein fuel is supplied via said auxiliary channel to said internal combustion engine during idling during each second to eighth revolution of said crankshaft.

23. A method according to claim 19, which includes the steps of controlling the quantity of fuel supplied to said internal combustion engine via said auxiliary channel via a valve, opening said valve during first revolutions for a prescribed time span (a), and keeping said valve closed during second revolutions.

24. A method according to claim 19, wherein the fuel is supplied via said auxiliary channel as enriched fuel/air mixture.

25. A method according to claim 19, wherein fuel is supplied to said internal combustion engine in at least one operating state via only either said auxiliary channel or said intake channel.

26. A method according to claim 19, wherein during full throttle operation of said internal combustion engine, fuel/air mixture is supplied to said internal combustion engine via said intake channel and via said auxiliary channel.

27. A method according to claim 19, which includes the step of temporarily storing combustion air from an air channel in said at least one transfer channel.

* * * * *